US007764019B2

(12) United States Patent
Boehme et al.

(10) Patent No.: US 7,764,019 B2
(45) Date of Patent: Jul. 27, 2010

(54) LAMP AND METHOD OF MANUFACTURING A LAMP

(75) Inventors: Oliver Boehme, Aachen (DE); Thomas Frings, Alsdorf (DE); Wilhelmus Johannes Jacobus Welters, Weert (NL); Marten Willem Schuiteman, Nuenen (NL); Johannes Martinus Jansen, Veldhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 231 days.

(21) Appl. No.: 11/996,593

(22) PCT Filed: Jul. 14, 2006

(86) PCT No.: PCT/IB2006/052413

§ 371 (c)(1),
(2), (4) Date: Jan. 24, 2008

(87) PCT Pub. No.: WO2007/012995

PCT Pub. Date: Feb. 1, 2007

(65) Prior Publication Data

US 2008/0197767 A1 Aug. 21, 2008

(30) Foreign Application Priority Data

Jul. 26, 2005 (EP) ..... 05106869

(51) Int. Cl.
*H01J 17/18* (2006.01)

(52) U.S. Cl. ..... 313/623; 313/624; 313/625

(58) Field of Classification Search ..... 313/623–626
See application file for complete search history.

(56) References Cited

U.S. PATENT DOCUMENTS

| | | | | |
|---|---|---|---|---|
| 3,420,944 A | | 1/1969 | Holcomb | |
| 3,723,792 A | * | 3/1973 | Chiola et al. | 313/318.02 |
| 3,798,058 A | * | 3/1974 | Chiola et al. | 427/120 |
| 4,612,475 A | * | 9/1986 | Downing | 313/640 |
| 4,918,353 A | * | 4/1990 | Nelson et al. | 313/113 |
| 5,387,840 A | | 2/1995 | Noteleteirs et al. | |

FOREIGN PATENT DOCUMENTS

| | | |
|---|---|---|
| EP | 0309749 B1 | 2/1993 |
| EP | 0375402 B1 | 3/1998 |

* cited by examiner

*Primary Examiner*—Vip Patel

(57) ABSTRACT

A lamp includes an envelope of a vitreous composition, having a pinched part at least one end to form a seal isolating an interior of the envelope from the environment of the envelope, and an arrangement for conducting electrical current to the interior of the envelope, having a section embedded in one of the pinched parts of the envelope and a section external to the envelope. At least part of embedded section of the arrangement for conducting electrical current is at least partly surrounded by a composition including at least one of phosphorus in a non-volatile form and an acid thereof.

16 Claims, 4 Drawing Sheets

LAMP AND METHOD OF MANUFACTURING A LAMP

The invention relates to a lamp, including an envelope of a vitreous composition, having a pinched part at least one end to form a seal isolating an interior of the envelope from the environment of the envelope, an arrangement for conducting electrical current to the interior of the envelope, having a section embedded in one of the pinched parts of the envelope and a section external to the envelope.

The invention also relates to a method of manufacturing a lamp, including providing an envelope of a vitreous composition, open at least one end, providing at least one arrangement for conducting electrical current, inserting an arrangement for conducting electrical current through at least one of the open ends, so as to leave a section of the arrangement protruding from an open end-pinching off the open end from which the section protrudes, so as to form a pinched part of the envelope, isolating an interior of the envelope from its environment, in which pinched part a further section of the arrangement for conducting electrical current is embedded.

Respective examples of such a lamp and method of manufacturing a lamp are known. U.S. Pat. No. 5,387,840 discloses an electric lamp. It has a glass vessel in the wall of which current conductors of molybdenum or tungsten are accommodated, which extend to the outside. The metal current conductors comprise a molybdenum foil embedded in the wall of the lamp vessel, to which a molybdenum wire is welded. A capillary channel extends around the wire up to the foil, so that the entire wire and a portion of the foil are in contact with the atmosphere surrounding the lamp. To produce an example, a constructionally completed lamp was exposed to the vapour of red phosphorus for approximately fifteen minutes at approximately 800° C. A skin of molybdenum phosphide was created by this all round the molybdenum wire, as well as on those portions of the foil which adjoin the capillaries.

A problem of the known method is that the known manner of surface treatment of the exposed molybdenum is cumbersome.

It is an object of the invention to provide an alternative lamp and method of manufacturing a lamp of the types set out in the opening paragraphs wherein the seal remains effective over a relatively long period of time.

This object is achieved by the lamp according to the invention, which is characterised in that at least part of the embedded section of the arrangement for conducting electrical current is at least partly surrounded by a composition including at least one of phosphorus in a non-volatile form and an acid thereof.

It has been found that the composition is very effective in prolonging the lifetime of the seal, especially at the temperatures typical for electric lamps. Examples include halogen lamps, metal halide lamps and gas discharge lamps. Upon manufacturing, the arrangement for conducting electrical current is at least partly surrounded by a composition including at least one of phosphorus in a non-volatile form and an acid thereof. Thus, the composition remains present and effective after manufacturing of the lamp, as the components active in inhibiting oxidisation are applied, and remain, in a persistent form. When the lamp is first used, heat is produced in the arrangement for conducting electrical current. After some time, components of the composition may vaporize and interact with the parts to be protected against oxidisation. Thus, it is not necessary to bring the lamp into an environment containing phosphorous vapour during manufacturing of the lamp.

In an embodiment, the composition is formed by a composition including phosphorus in solid form This embodiment has been found to provide the longest lasting seals.

In an embodiment, the composition includes particles of red phosphorus.

This composition is easiest to handle. The red phosphorus is safest to handle. Moreover, it is safe to use at the temperatures occurring in lamps such as halogen lamps, ordinary incandescent lamps and metal halide lamps, for example.

In an embodiment, at least part of the arrangement for conducting electrical current is coated with a surface layer of material for protecting against oxidisation, including at least one of an oxide and a metallic material.

It has been found that the combination of the surface layer and composition including phosphorus and/or an acid of phosphorus leads to a prolonging of the lifetime of the seal that exceeds the prolonging expected from combining the individual measures.

In a variant of this embodiment, at least part of the embedded section of the arrangement for conducting electrical current is free of the surface layer of material, and the surface layer of material has a different composition from the arrangement for conducting electrical current.

This has the advantage that the arrangement for conducting electrical current can be chosen to form a relatively good seal with the pinched part of the envelope, whereas the material of the surface layer is selected for its suitability for inhibiting oxidisation. The coated part is situated closer to the section external to the envelope than the part that is free of the surface layer of material in such an embodiment.

In an embodiment, the embedded section of the arrangement for conducting electrical current includes a molybdenum component.

The molybdenum component is very suitable for forming a seal with the kinds of vitreous materials of which the lamp envelope is preferably made, notably quartz glass.

In a variant of this embodiment, the section external to the envelope includes a section of a lead welded to the molybdenum component at an end embedded in the pinched part of the envelope, and at least the weld is surrounded by the composition.

Inhibiting oxidisation of the weld has a relatively large effect on the lifetime of the seal. This is due to the fact that most of the oxygen enters the pinched part through the area immediately adjacent the lead, and the fact that the weld is a relatively thick part of the arrangement for conducting electrical current, so that volume increases of this part are relatively large.

According to another aspect, the method of manufacturing a lamp is characterised by applying to at least part of the further section of the arrangement for conducting electrical current a composition including at least one of phosphorus in a non-volatile form and an acid thereof.

Thus, oxidisation of the arrangement for conducting electrical current is inhibited relatively effectively. This in turn inhibits volume changes of the arrangement, which could cause stress in the pinched part leading to breaking of the seal.

In an embodiment, wherein the protruding section of the arrangement for conducting electrical current comprises a section of a lead, a capillary is formed around an embedded section of the lead when the open end is pinched off, and the composition is applied in fluid form at an open end of the capillary.

This is a particularly effective way of applying the composition to a site close to the embedded parts of the arrangement for conducting electrical current. The capillary forms naturally when the open end of the envelope is pinched off to form the seal. The composition need not be subjected to the high temperatures that occur when the envelope is pinched off, since it is applied after the pinched part has been formed.

An embodiment of the method includes providing an arrangement for conducting electrical current in which a lead is welded to a molybdenum component at an end, and pinching off the open end so as to embed the molybdenum component in the pinched part of the envelope, wherein the composition is applied to at least the weld.

Because the seal is most likely to break at the location of the weld, this has a relatively large effect on the lifetime of the seal.

An embodiment of the method includes applying a composition including phosphorus in solid form. A preferred variant, wherein a suspension of phosphorus particles in a liquid medium is applied, includes letting at least part of the liquid medium evaporate through at least one opening in the pinched part of the envelope.

This allows a fluid composition to be applied, providing ease of manufacturing. Letting a relatively volatile liquid medium evaporate is an easy way of removing the liquid medium, so that little of it leaks out during transportation of the lamp.

An embodiment includes providing at least one arrangement for conducting electrical current, at least partially coated with a surface layer of material for protecting against oxidisation, including at least one of an oxide and a metallic material.

It has been found experimentally that the combined use of the surface layer and the composition leads to an increase in the lifetime of the seal exceeding the sum of the increases found when each measure is applied individually.

An embodiment includes providing at least one arrangement for conducting electrical current, having at least one region free of the surface layer of material, wherein the surface layer of material has a different composition from the arrangement for conducting electrical current, and pinching off the open end from which the section protrudes, such that at least the region free of the surface layer of material is embedded in the pinched part of the envelope.

The materials of the arrangement for conducting electrical current and of the surface layer are chosen to optimise their functions. The region free of the surface layer of material interacts with the vitreous composition of the envelope to form a good seal. The material of the surface layer is optimised for protecting from oxidisation.

The invention will be explained in further detail with reference to the accompanying drawings, in which.

Features to increase the lifetime of burners for electric lights will be set out herein using a halogen burner as a first example. They are, however, equally applicable to lamps operating on different principles, such as ordinary incandescent lamps not employing the halogen cycle, metal-halide lamps, high-intensity discharge tubes, mercury vapour lamps, sodium vapour lamps, etc. Features common to these lamps are shown in a hypothetical generic lamp in FIG. 4. In each of the lamps mentioned, an interior of an envelope contains a gas and/or vapour mixture that is to be isolated from the environment of the envelope. Electrodes or filaments are situated in the interior of the envelope and connected to terminals by means of an arrangement for conducting electrical current, which arrangement necessarily has to pass through the envelope. The features described herein contribute to the prolonging of the seal between the interior and the exterior of the envelope, particularly in the region where the arrangement for conducting electrical current passes through the envelope. A primary cause for loss of the seal is oxidisation of components of the arrangement for conducting electrical current that are embedded in the material of the envelope. The oxidisation causes stresses in the material of the envelope.

It has been discovered that using a composition including at least one of phosphorus and an acid thereof, helps to inhibit oxidisation. It has also been discovered that such use in combination with the application of a metallic surface coating to the part prone to oxidisation leads to an even more significant prolonging of the lifetime of the seal. In fact the increase in lifetime exceeds the sum of the increases achievable with each of these features when applied in isolation.

Figure 1:
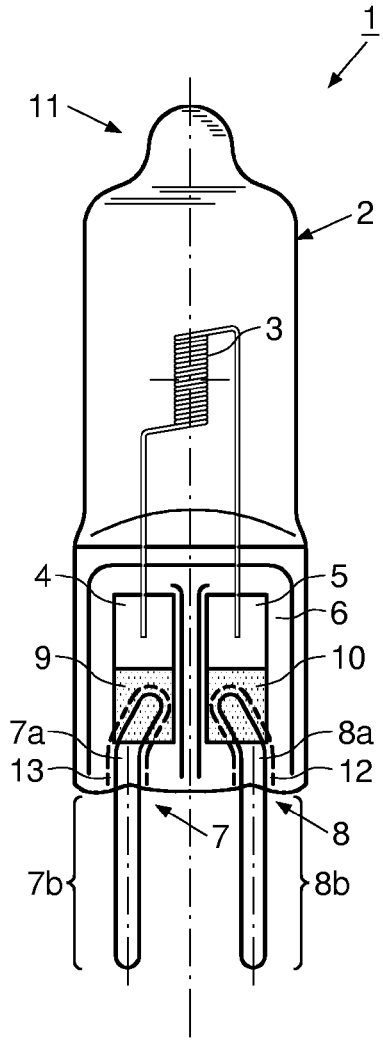
FIG. 1 is a front view of a single-ended halogen lamp with features to increase its useful lifetime.
Figure 2:
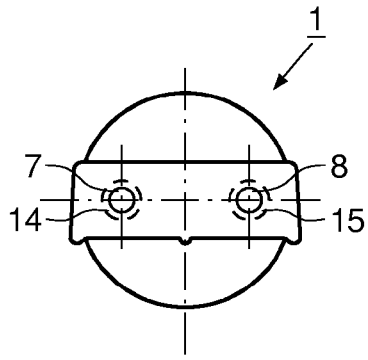
FIG. 2 is a plan view of the terminal end of the lamp shown in FIG. 1.
Figure 3:
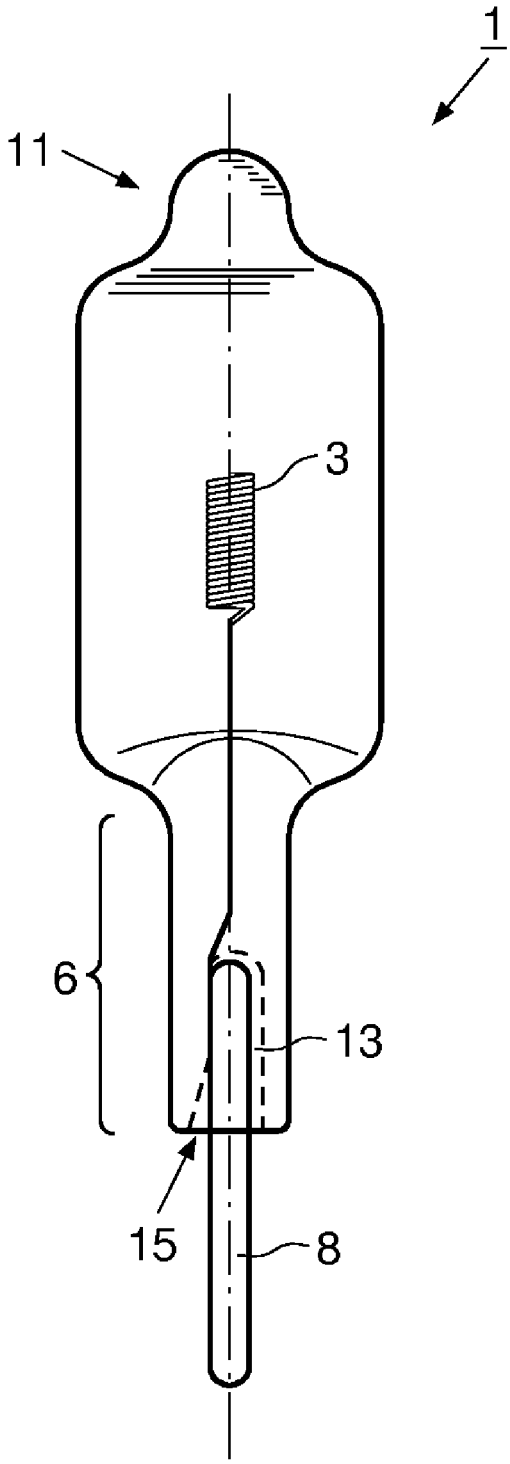
FIG. 3 is a side view of the lamp shown in FIGS. 1 and 2.

In the following, the terms burner and lamp are used interchangeably. FIGS. 1-3 show a single-ended halogen burner, referred to as SE burner 1. The SE burner 1 comprises an SE burner envelope 2 of a material with a vitreous composition. The material used is quartz, but other types of glass or glass-like materials are suitable in certain applications. The SE burner envelope 2 has an interior filled with a halogen gas such as iodine or bromine. A filament 3 is present in the interior of the SE burner envelope 2. The filament 3 is made of tungsten or molybdenum in most embodiments. An alloy is also suitable for certain applications.

Opposite ends of the filament 3 are connected to respective pieces 4,5 of molybdenum foil. The pieces 4,5 of molybdenum foil are embedded in a pinched part 6 of the SE burner envelope 2. The pieces 4,5 of molybdenum foil are especially suited to forming an effective seal of an SE burner envelope 2 made of quartz. Pins 7,8 are connected to the respective pieces 4,5 of molybdenum foil by welds. The pins 7,8 each have a section 7*a*,8*a* embedded in the pinched part 6, and a section 7*b*,8*b* that protrudes from the exterior of the SE burner envelope 2, and is thus external to it. The connections of the pins 7,8 and the filament 3 to the pieces 4,5 of molybdenum foil allow electrical current to be conducted through the filament 3 to generate light.

To manufacture the SE burner 1, the pins 7,8 are first welded to the pieces 4,5 of molybdenum foil. Then, parts 9,10 of the resulting arrangement for conducting electrical current are coated with a protective surface layer, comprising a material for protection against oxidisation. The material is a metallic material in the majority of embodiments. In certain embodiments, an oxide such as $Al_xO_y$, $TiO_x$ or $SiO_x$, is used. In certain embodiments, a metal forming a protective oxide surface layer is used, or an alloy including such a metal. In other embodiments, a noble metal is used. An example of a material that has proved to be particularly effective in combination with red phosphorus is chromium. Other suitable materials include nickel, cobalt, silver, tantalum, iridium, platinum, rhodium, rhenium and alloys and combinations thereof. Advantageously, a material having a melting point in a range between 1800° C. and 2300° C. is used in combination with an SE burner envelope 2 made of quartz. This allows for easy processing of intermediates when manufacturing the SE burner 1. In particular, formation of the pinched part 6 without adverse effects on the surface layer applied beforehand is possible.

A precursor of the SE burner envelope 2 is formed, which is closed at a first end 11, and open at an opposite end. The arrangement comprising the filament 3, pieces 4,5 of molybdenum foil and pins 7,8 is inserted through the open end, so as to leave the sections 7,*b*,8*b* protruding. The open end is then pinched off to form the pinched part 6, which isolates the interior of the SE burner envelope 2 from its environment. When the pinched part 6 is formed, small capillaries 12,13 are formed around the embedded sections 7*a*,8*a* of the pins 7 and 8 respectively. As is visible in FIG. 3, the capillaries 12,13 have openings 14,15 where the pins 7,8 protrude from the SE burner envelope 2. It is observed that the capillaries 12,13 are not shown to scale for purposes of clarity.

Subsequent to the step of forming the pinched part 6, a liquid composition is applied. The liquid composition includes at least one of phosphorus and an acid thereof. It is applied, for instance using a hollow needle, to the openings 14,15. Due to the capillary effect, it reaches the site of the weld of the pins 7,8 to the pieces 4,5 of molybdenum foil. Phosphoric acid has been found to be effective in helping to inhibit oxidisation of the surface-coated welds of the pins 7,8 to the pieces 4,5 of molybdenum foil.

Phosphorus has been found to be even more effective than phosphoric acid, and is thus used in the embodiment described herein. In this example, the liquid composition takes the form of a suspension of phosphorus particles in a volatile liquid medium. A volatile liquid medium makes packaging and transport of the finished SE burner 1 relatively uncomplicated, due to the rapid evaporation of the medium at room temperature or higher. Suitable liquid media include ethanol and methyl isobutyl ketone. For safety reasons, particles of the red allotrope of phosphorus are used in this embodiment.

The finished SE burner 1 has a relatively long lifetime. The rate of oxidisation at operating temperatures of 200° C. to 500° C. is relatively low compared to other types of burner.

Figure 4:
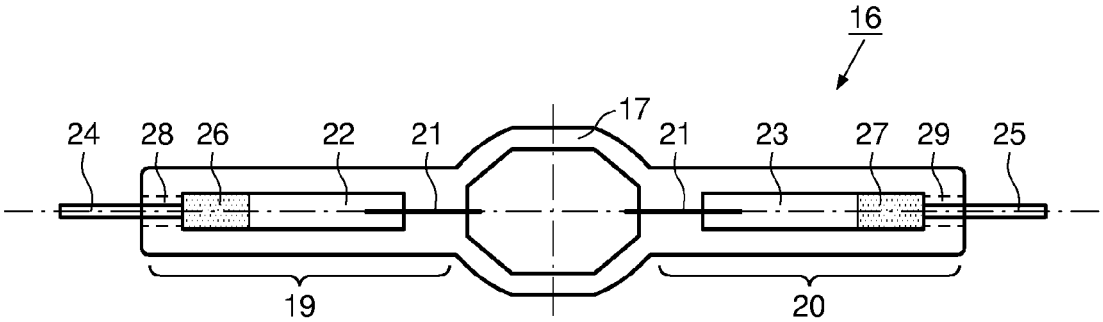
FIG. 4 is a front view of a generic double-ended lamp with features to increase its useful lifetime.

FIG. 4 shows an example of a double-ended burner, referred to as DE burner 16. The DE burner 16 comprises a DE burner envelope 17, made of a vitreous material such as quartz. A first connecting lead 18 extends into the interior of the DE burner envelope 17. It may form part of an electrode or filament similar to the filament 3 of the SE burner 1, depending on the type of lamp.

The DE burner envelope 17 comprises opposite pinched parts 19,20. Each forms a seal for isolating the interior of the DE burner envelope 17 from its environment. The DE burner envelope 17 comprises two arrangements for conducting electrical current to the interior of the DE burner envelope 17. In one example, they share a filament (not shown) extending between the first connecting lead 18 and an opposite second connecting lead 21. In an alternative example, the first and second connecting leads 18,21 conduct current through electrodes and an arc inside the DE burner envelope 17. Ends of the first and second connecting leads 18,21 are connected to pieces 22,23 of molybdenum foil, which, in this example, are fully embedded in the pinched parts 19,20.

Opposite pins 24,25 are welded to respective ones of the pieces 22,23 of molybdenum foil. Respective regions 26,27 of the pieces 22,23 molybdenum foil and pins 24,25 welded thereto have been coated with a metallic surface layer for protecting against oxidisation of the regions 26,27. In principle, all of the coating materials mentioned with regard to the corresponding surface-coated parts 9,10 in the embodiment of FIGS. 1-3 are suitable. As in that case, the coating is applied on top of the regions 26,27, being formed of a different material than the underlying parts.

The DE burner 16 is manufactured in substantially the same way as the SE burner 1. Capillaries 28,29 are similarly formed around the pins 24,25. Subsequent to formation of the pinched parts 19,20 with the capillaries 28,29, a liquid composition including one of phosphorus and an acid thereof is applied to openings of the capillaries 28,29. Thence is it transported to the welded ends of the pins 24,25. All of the types of composition mentioned with regard to the SE burner 1 are usable for prolonging the lifetime of the DE burner 16.

Figure 5:
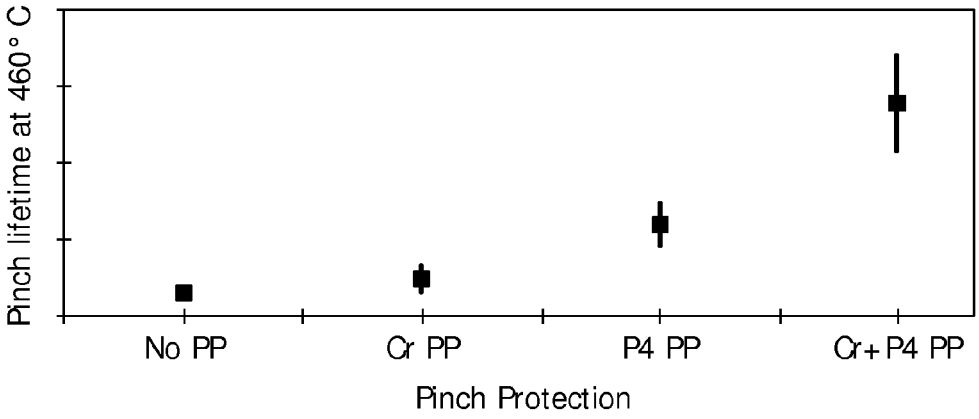
FIG. 5 is a diagram showing the results of a test of various methods of inhibiting oxidisation as applied to lamps of one particular type.
Figure 6:
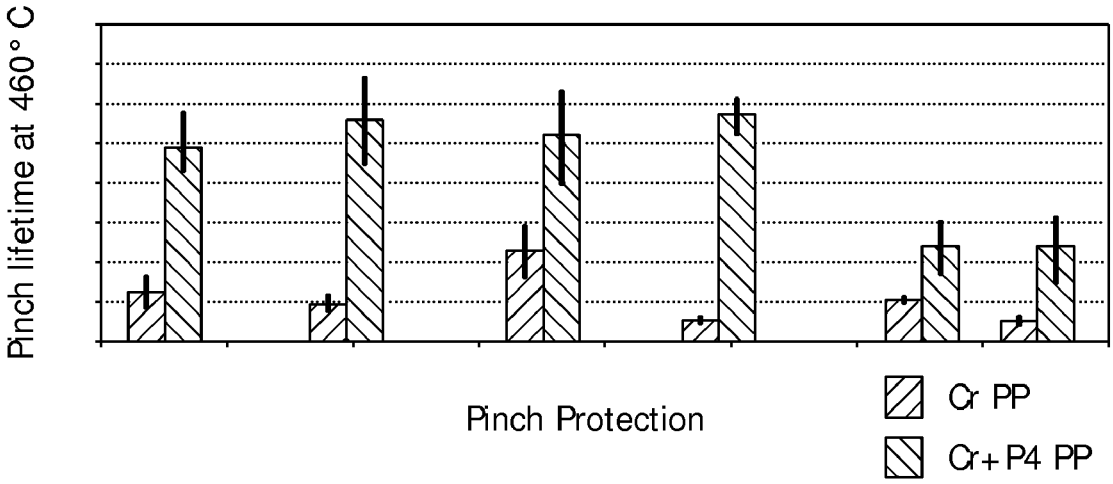
FIG. 6 is a diagram showing the results of tests of various methods of inhibiting oxidisation as applied to different types of lamps.

FIGS. 5 and 6 demonstrate the improvements attainable by applying the methods outlined above. FIG. 5 shows the results of tests conducted on one type of burner. A first batch of ten burners was manufactured without applying either a metallic surface layer or a phosphorous composition. A second batch of ten burners was manufactured with only a metallic surface layer in regions such as the surface-coated parts 9,10 and coated regions 26,27 present in the embodiments described in detail above. The metallic layer included chromium. In a third batch of ten burners, no metallic surface layer was applied. Only a suspension of red phosphorus particles was applied. In a fourth batch of ten burners, both measures were applied. A metallic surface layer including chromium was applied to welds between pins and an embedded molybdenum component. The same suspension of red phosphorus particles as used in the third batch was used to manufacture the fourth batch.

Each of the batches of ten burners was subjected to a temperature of 460° C., and the time to failure was measured. The y-axis represents the lifetime using normalised values. The squares indicate average lifetime values for the respective batches. The bars indicate the standard deviation of the lifetime values for the ten members of a batch.

It will be apparent that the use of the suspension of red phosphorus particles yields a significant improvement in lifetime. The improvement due to the combined use of the phosphorous composition and chromium surface coating is much more marked than would be expected from adding the average values for the second and third batch.

FIG. 6 shows the results of the same test for twelve batches of ten burners. In each of six cases, ten burners in which only a chromium surface coating has been used are compared with ten burners in which both the suspension of red phosphorus particles and the chromium surface coating have been used. The six cases differ as to burner geometry, time of manufacturing etc. In each case, batches are compared against batches of burners with the same design, manufactured at the same time. The thin lines represent the standard deviation of the lifetime for the ten burners in a batch. The bars represent the average values for the batch concerned. In each case, the marked increase in lifetime due to the application of the suspension of red phosphorus particles is clearly visible.

It should be noted that the above-mentioned embodiments illustrate, rather than limit, the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The mere fact that certain measures are recited in mutually different dependent claims does not indicate that a combination of these measures cannot be used to advantage.

Other types of molybdenum component than the pieces 4,5,22,23 of molybdenum foil may be fixed firmly in the surrounding mass of quartz that forms the pinched part 6,19, 20 of the burner envelope. Other materials than molybdenum can be used, as long as they are compatible with the vitreous material of the pinched part of the burner envelope in that they are suitable for forming a hermetic seal. It is conceivable that red phosphorus particles are applied to the arrangement for conducting electrical current prior to embedding it in a pinched part of the burner envelope. Passages exhibiting relatively little or no capillary forces may be used to bring the phosphorous composition in the vicinity of the area to be protected against oxidisation.

The invention claimed is:

1. A lamp comprising an envelope of a vitreous composition, the envelope having a pinched part at one or both ends to form a seal isolating an interior of the envelope from the environment of the envelope, an arrangement of electrically-conducting materials for conducting electrical current to the interior of the envelope, the electrically-conducting materials having a section embedded in one of the pinched parts of the envelope and a section external to the envelope, wherein at least a portion of the embedded section of the electrically-conducting materials is at least partly surrounded by a non-volatile residue of a composition containing phosphorus or phosphoric acid.

2. A lamp according to claim 1, wherein the phosphorus is in solid form.

3. A lamp according to claim 2, wherein the phosphorus is particulate red phosphorus.

4. A lamp according to claim 1, wherein at least part of the arrangement of electrically-conducting materials is coated with a surface layer of material for protecting against oxidisation, including at least one of an oxide and a metallic material.

5. A lamp according to claim 4, wherein at least part of the embedded section of the arrangement for conducting electrical current is free of the surface layer of material, and wherein the surface layer of material has a different composition from the arrangement for conducting electrical current.

6. A lamp according to claim 4, wherein the material of the surface layer includes chromium.

7. A lamp according to claim 1, wherein the embedded section of the arrangement for conducting electrical current includes a molybdenum component.

8. A lamp according to claim 7, wherein the section external to the envelope includes a section of a lead welded to the molybdenum component at an end embedded in the pinched part of the envelope, wherein at least the weld is surrounded by the non-volatile residue of the composition.

9. A method for manufacturing a lamp, the method comprising providing an envelope of a vitreous composition, open at one or both ends, providing at least one arrangement of electrically-conducting materials for conducting electrical current, inserting the arrangement of electrically-conducting materials through at least one of the open ends, so as to leave a first section of the arrangement of electrically-conducting materials protruding from an open end;

pinching off the open end of the envelope from which the first section protrudes, so as to form a pinched part of the envelope, thereby isolating an interior of the envelope from its environment, wherein a second section of the arrangement of electrically-conducting materials is embedded in the pinched part, applying to at least part of the second section of the arrangement of electrically-conducting materials a composition including at least one of phosphorus in a non-volatile form or phosphoric acid.

10. A method according to claim 9, wherein a capillary is formed around the embedded second section of the arrangement of electrically-conducting materials in the pinched part of the envelope, the capillary having an opening at the end of the pinched part, and wherein the composition is applied in fluid form at the opening of the capillary.

11. A method according to claim 9, further comprising providing an arrangement of electrically-conducting materials comprising a lead welded to a molybdenum component, and pinching off the open end of the envelope so as to embed the molybdenum component in the pinched part of the envelope, and applying the composition to at least the weld.

12. A method according to claim 9 wherein the phosphorus is in solid form.

13. A method according to claim 12, wherein a suspension of phosphorus particles in a liquid medium is applied, including letting at least part of the liquid medium evaporate through at least one opening in the pinched part of the envelope.

14. A method according to claim 9, further comprising providing at least one arrangement of electrically-conducting materials at least partially coated with a surface layer of material for protecting against oxidisation, including at least one of an oxide and a metallic material.

15. A method according to claim 14, further comprising providing at least one arrangement of electrically-conducting materials having at least one region free of the surface layer of the material for protecting against oxidisation, wherein the surface layer of the material for protecting against oxidisation has a different composition from the arrangement of electrically-conducting materials, and pinching off the open end from which the first section protrudes, such that at least the region free of the surface layer of the material for protecting against oxidisation is embedded in the pinched part of the envelope.

16. A method according to claim 14, wherein the material for protecting against oxidisation has chromium as a component.

* * * * *